US010720717B2

(12) United States Patent
Xu et al.

(10) Patent No.: US 10,720,717 B2
(45) Date of Patent: Jul. 21, 2020

(54) CONDUCTIVE TERMINAL AND CONNECTOR

(71) Applicant: Tyco Electronics (Shanghai) Co. Ltd., Shanghai (CN)

(72) Inventors: Qin Xu, Shanghai (CN); Hongbo Zhang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/292,831

(22) Filed: Mar. 5, 2019

(65) Prior Publication Data

US 2019/0280398 A1 Sep. 12, 2019

(30) Foreign Application Priority Data

Mar. 9, 2018 (CN) ..... 2018 1 0193981

(51) Int. Cl.
*H01R 4/18* (2006.01)

(52) U.S. Cl.
CPC ..... *H01R 4/184* (2013.01)

(58) Field of Classification Search
CPC H01R 13/4223; H01R 13/4362; H01R 4/184; H01R 14/185; H01R 43/048
USPC ..... 439/595, 851, 686, 877
See application file for complete search history.

(56) References Cited

U.S. PATENT DOCUMENTS 5,007,865 A * 4/1991 Jakobeit ..... H01R 13/18 439/839
5,240,439 A * 8/1993 Egenolf ..... H01R 13/18 439/745
5,360,356 A * 11/1994 May ..... H01R 13/18 439/839
5,607,328 A * 3/1997 Joly ..... H01R 13/11 439/851
5,695,368 A * 12/1997 Joly ..... H01R 13/432 439/748
5,947,777 A * 9/1999 Chaillot ..... H01R 13/428 439/852
5,951,339 A * 9/1999 Chaillot ..... H01R 13/113 439/852
6,132,264 A * 10/2000 Egenolf ..... H01R 13/18 439/843
6,146,215 A * 11/2000 Matsushita ..... H01R 13/113 439/752
6,203,385 B1 * 3/2001 Sato ..... H01R 13/113 439/852
6,439,935 B2 * 8/2002 Saka ..... H01R 13/113 439/842
6,692,316 B2 * 2/2004 Hsieh ..... H01R 13/187 439/224
6,872,103 B1 * 3/2005 Flieger ..... H01R 13/18 439/752.5

(Continued)

*Primary Examiner* — Peter G Leigh
(74) *Attorney, Agent, or Firm* — Barley Snyder

(57) ABSTRACT

A conductive terminal adapted to be mounted in an insulation housing of a connector includes a mating portion disposed at a front of the conductive terminal and adapted to engage a mating terminal of a mating connector, a crimping portion disposed at a rear of the conductive terminal and adapted to be crimped onto a wire, and a pressing portion disposed at a rear end of the crimping portion and extending outward. The conductive terminal is adapted to be held in the insulation housing by pushing the pressing portion.

20 Claims, 4 Drawing Sheets

(56) References Cited

U.S. PATENT DOCUMENTS

| | | | | |
|---|---|---|---|---|
| 7,192,318 | B2 * | 3/2007 | Hotea | H01R 13/113 439/397 |
| 7,241,190 | B2 * | 7/2007 | Smyk | H01R 13/187 439/852 |
| 9,147,957 | B2 * | 9/2015 | Randolph | H01R 13/424 |
| 2017/0047677 | A1 * | 2/2017 | Bhagyanathan Sathianathan | H01R 13/113 |

* cited by examiner

CONDUCTIVE TERMINAL AND CONNECTOR

CROSS-REFERENCE TO RELATED APPLICATIONS

This application claims the benefit of the filing date under 35 U.S.C. § 119(a)-(d) of Chinese Patent Application No. 201810193981.4, filed on Mar. 9, 2018.

FIELD OF THE INVENTION

The present invention relates to a connector and, more particularly, to a conductive terminal of the connector.

BACKGROUND

A connector generally comprises an insulation body, a conductive terminal, and a terminal position assurance (TPA). The conductive terminal is mounted in a mounting groove of the insulation body and the TPA is inserted into the mounting groove of the insulation body from the rear of the insulation body. A front end surface of the TPA is in contact with a rear end surface of an insulation sheath crimping portion of the conductive terminal, which is crimped to an insulation sheath of a wire. The TPA pushes the conductive terminal forward, thereby holding the conductive terminal in the insulation body to prevent the conductive terminal from loosening.

The TPA must be in contact with the rear end surface of the insulation sheath crimping portion of the conductive terminal to hold the conductive terminal. However, since an area of the rear end surface of the insulation sheath crimping portion of the conductive terminal is small, a contact area between the TPA and the rear end surface of the insulation sheath crimping portion is small, and therefore the TPA cannot reliably hold the conductive terminal in the insulation body. In addition, the insulation sheath of the wire has a certain elasticity. When the insulation sheath crimping portion of the conductive terminal is crimped against the insulation sheath of the wire, the crimping portion of the conductive terminal may be caught into the insulation sheath of the wire, which may cause the TPA to be not in contact with the insulation sheath crimping portion of the conductive terminal, causing failure of the TPA.

SUMMARY

A conductive terminal adapted to be mounted in an insulation housing of a connector includes a mating portion disposed at a front of the conductive terminal and adapted to engage a mating terminal of a mating connector, a crimping portion disposed at a rear of the conductive terminal and adapted to be crimped onto a wire, and a pressing portion disposed at a rear end of the crimping portion and extending outward. The conductive terminal is adapted to be held in the insulation housing by pushing the pressing portion.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
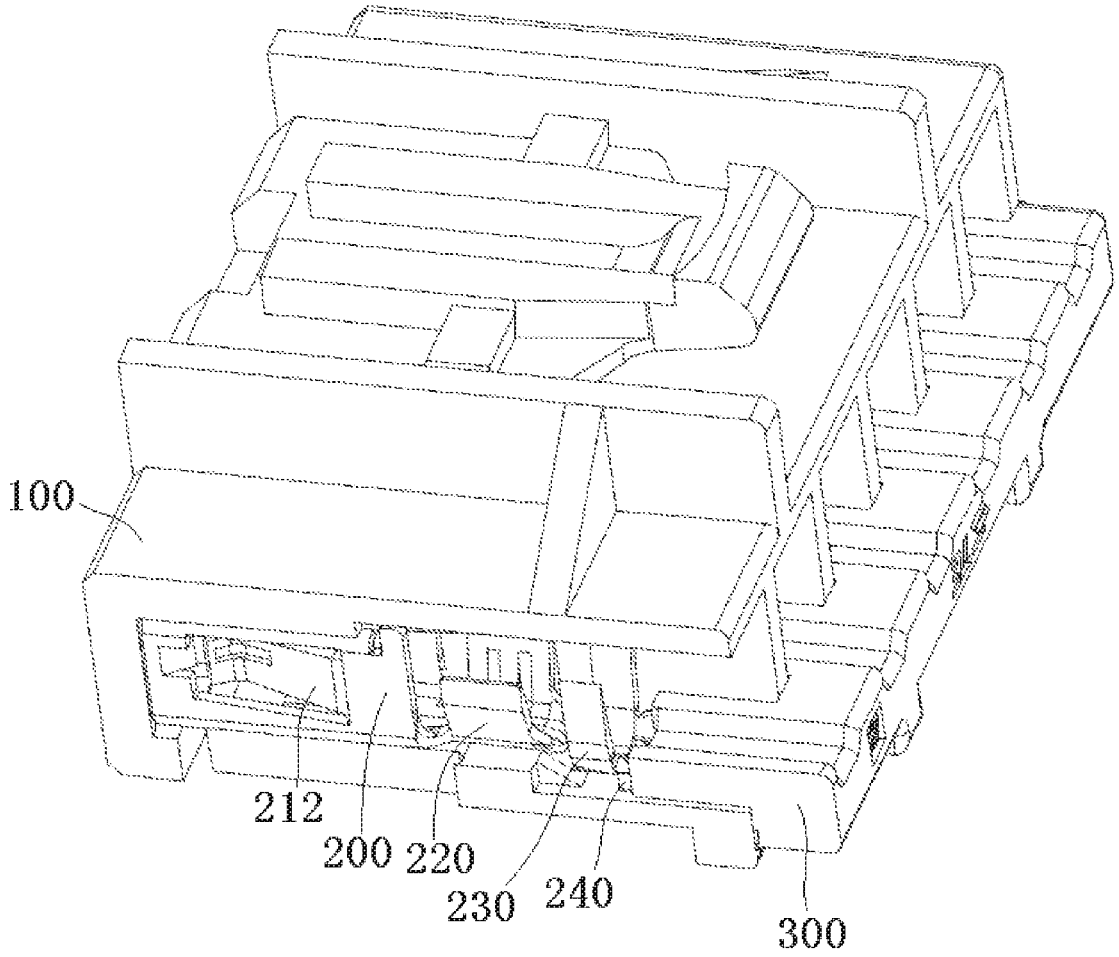
FIG. 1 is a perspective view of a connector according to an embodiment.

Embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the disclosure will convey the concept of the invention to those skilled in the art. In addition, in the following detailed description, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A connector according to an embodiment, as shown in FIG. 1, comprises an insulation housing 100, a conductive terminal 200 adapted to be mounted in the insulation housing 100, and a terminal position assurance (TPA) 300.

Figure 2:
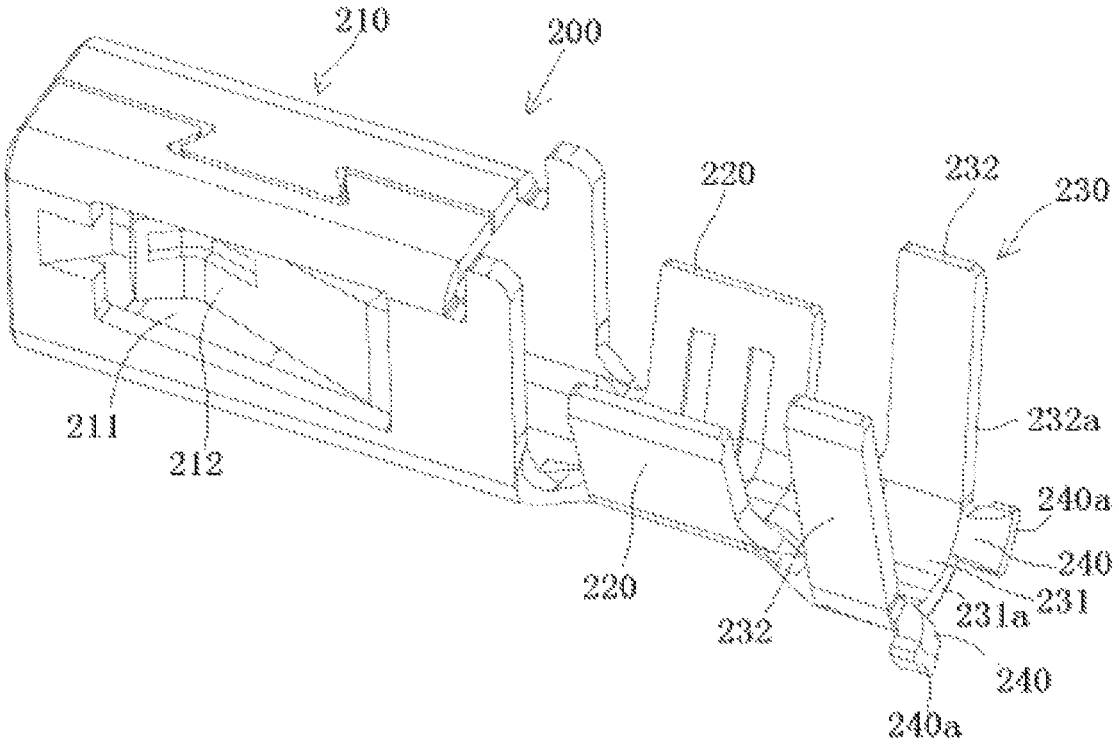
FIG. 2 is a perspective view of a conductive terminal of the connector of FIG. 1.

The conductive terminal 200, as shown in FIGS. 1 and 2, comprises a mating portion 210 and crimping portions 220, 230. The mating portion 210 is located at a front of the conductive terminal 200 and is adapted to engage with a mating terminal of a mating connector. The crimping portions 220, 230 are located at a rear of the conductive terminal 200 and are adapted to be crimped onto a wire. A pressing portion 240 is formed at a rear end of the crimping portions 220, 230 and extends outward; the conductive terminal 200 may be held in the insulation housing 100 of the connector by pushing the pressing portion 240. As shown in FIG. 1, the TPA 300 inserted into the insulation housing 100 holds the conductive terminal 200 in the insulation housing 100 by pushing the pressing portion 240.

In an embodiment, the entire conductive terminal 200 may be a single metal component made of a single sheet of metal. For example, the conductive terminal 200 may be made of a single sheet of metal through a process such as stamping, bending, or the like.

As shown in FIGS. 1 and 2, the crimping portions 220, 230 include a first crimping portion 220, which is adapted to be crimped onto a bare conductor of the wire, and a second crimping portion 230, which is located behind the first crimping portion 220 and adapted to be crimped onto an insulation sheath of the wire. The pressing portion 240 extending outward is formed at the rear end of the second crimping portion 230. A flat surface 240*a* is formed on the pressing portion 240 and adapted to engage with a front end surface of the TPA 300; the front end surface of the TPA 300 is adapted to abut against the flat surface 240*a* of the pressing portion 240 in order to push the conductive terminal 200 forward.

The second crimping portion 230, as shown in FIG. 2, includes a U-shaped base 231 and a pair of side portions 232 extending from two sides of the U-shaped base 231 respectively. The pressing portion 240 is formed on the U-shaped base 231 of the second crimping portion 230. A rear end surface 231*a* of the U-shaped base 231 is a flat surface, and the pressing portion 240 is connected to the rear end surface

231*a* of the U-shaped base 231 and bent outwardly by approximately 90° with respect to the U-shaped base 231.

In the embodiment shown in FIG. 2, a plurality of pressing portions 240 are formed at a rear end of the second crimping portion 230, and the plurality of pressing portions 240 are symmetrically distributed on either side of a vertical bisection plane of the second crimping portion 230.

The mating portion 210 of the conductive terminal 200, as shown in FIGS. 1 and 2, defines an insertion cavity and has a pair of elastic contact arms 212 adapted to be clamped onto the mating terminal of the mating connector inserted into the insertion cavity. Two openings 211 are formed in a pair of side walls of the insertion cavity of the mating portion 210 respectively. A rear end of the elastic contact arm 212 is connected to a rear side wall of the opening 211 and a front end of the elastic contact arm 212 projects into the insertion cavity of the mating portion 210.

Figure 3:
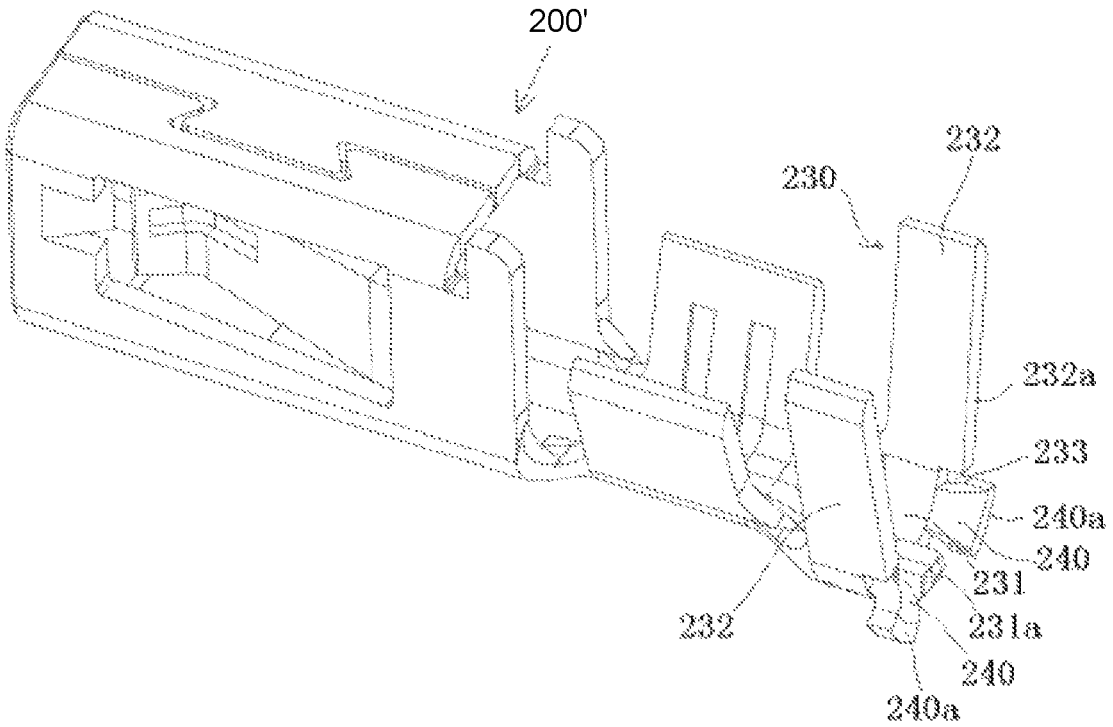
FIG. 3 is a perspective view of a conductive terminal according to another embodiment.

A conductive terminal 200' according to another embodiment is shown in FIG. 3. In the conductive terminal 200', a notch 233 having a predetermined depth is formed in a rear end surface 231*a* of the U-shaped base 231. The pressing portion 240 is connected to a bottom surface of the notch 233 and bent outwardly by approximately 90° with respect to the U-shaped base 231. In this embodiment, a space behind the second crimping portion 230 will not necessarily be occupied because at least a portion of the pressing portion 240 is accommodated in the notch 233, and therefore, the size of the conductive terminal 200' in a longitudinal direction is reduced.

Figure 4:
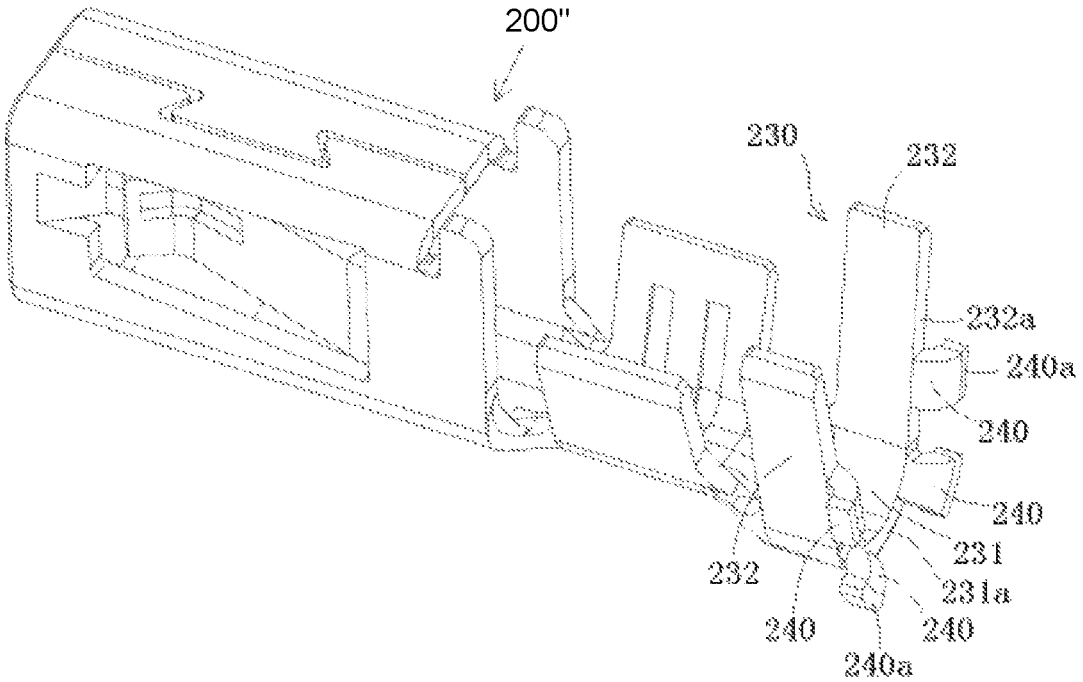
FIG. 4 is a perspective view of a conductive terminal according to another embodiment.

A conductive terminal 200" according to another embodiment is shown in FIG. 4. In the conductive terminal 200", the pressing portion 240 is not only formed on the U-shaped base 231 of the second crimping portion 230, but the pressing portion 240 is also formed on the side portion 232 of the second crimping portion 230. The pressing portion 240 on the side portion 232 is connected to the rear end surface 232*a* of the side portion 232 and bent outwardly by approximately 90° with respect to the side portion 232. In this embodiment, the number of pressing portions 240 is increased, so that a contact area between the TPA 300 and the second crimping portion 230 can be increased, and therefore, the TPA 300 can more reliably and stably hold the conductive terminal 200 in the insulation housing 100.

In the embodiments of the conductive terminal 200, 200', 200" described above, the pressing portion 240 extending outward is formed at the rear end of the crimping portion 230, so that the TPA 300 may reliably hold the conductive terminal 200 in the insulation housing 100 by pushing the pressing portion 240.

What is claimed is:

1. A conductive terminal adapted to be mounted in an insulation housing of a connector, comprising:

a mating portion disposed at a front of the conductive terminal and adapted to engage a mating terminal of a mating connector;

a crimping portion disposed at a rear of the conductive terminal and adapted to be crimped onto a wire, the crimping portion including a notch having a predetermined depth formed in a rear end surface thereof; and a pressing portion connected to a bottom surface of the notch and extending outward therefrom, the conductive terminal is adapted to be held in the insulation housing by pushing the pressing portion.

2. The conductive terminal of claim 1, wherein the connector includes a terminal position assurance inserted into the insulation housing and pushing the pressing portion to hold the conductive terminal in the insulation housing.

3. The conductive terminal of claim 2, wherein the pressing portion has a flat surface adapted to engage a front end surface of the terminal position assurance.

4. The conductive terminal of claim 1, wherein the crimping portion includes a first crimping portion adapted to be crimped onto a bare conductor of the wire and a second crimping portion located behind the first crimping portion and adapted to be crimped onto an insulation sheath of the wire, the pressing portion is disposed at a rear end of the second crimping portion.

5. The conductive terminal of claim 4, wherein the second crimping portion has a U-shaped base and a pair of side portions each extending from a side of the U-shaped base.

6. The conductive terminal of claim 5, wherein the notch is formed in the U-shaped base.

7. The conductive terminal of claim 6, wherein the bottom surface of the notch is a flat surface, the pressing portion is bent outwardly by approximately 90° with respect to the U-shaped base.

8. The conductive terminal of claim 6, wherein the pressing portion is also disposed on the side portions of the second crimping portion.

9. The conductive terminal of claim 8, wherein the pressing portion is connected to a rear end surface of the side portion and bent outwardly by approximately 90° with respect to the side portion.

10. The conductive terminal of claim 5, wherein a plurality of pressing portions are disposed at the rear end of the second crimping portion and are symmetrically distributed on either side of a vertical bisection plane of the second crimping portion.

11. The conductive terminal of claim 1, wherein the mating portion defines an insertion cavity and includes a pair of elastic contact arms adapted to clamp the mating terminal inserted into the insertion cavity.

12. The conductive terminal of claim 11, wherein a pair of openings are formed in a pair of side walls of the insertion cavity, a rear end of each of the elastic contact arms is connected to a rear side wall of one of the openings and a front end of each of the elastic contact arms projects into the insertion cavity.

13. The conductive terminal of claim 1, wherein the bottom surface of the notch comprises a rear-facing surface, and wherein at least a portion of the pressing portion is arranged within the notch.

14. A connector, comprising:

an insulation housing;

a conductive terminal mounted in the insulation housing and including a mating portion disposed at a front of the conductive terminal and adapted to engage a mating terminal of a mating connector, a crimping portion having a U-shaped base and a pair of linear side portions each extending from a side of the U-shaped base disposed at a rear of the conductive terminal and adapted to be crimped onto a wire, and a pressing portion disposed at a rear end of the crimping portion and extending outward; and a terminal position assurance inserted into the insulation housing and configured to holding the conductive terminal in the insulation housing by pushing the pressing portion.

15. The connector of claim 14, wherein a notch having a predetermined depth is formed in a rear end surface of the U-shaped base, the pressing portion is connected to a bottom surface of the notch and bent outwardly by approximately 90° with respect to the U-shaped base.

16. The connector of claim 14, wherein the crimping portion includes a first crimping portion adapted to be crimped onto a bare conductor of the wire and a second crimping portion located behind the first crimping portion and adapted to be crimped onto an insulation sheath of the wire, the pressing portion is disposed at a rear end of the second crimping portion.

17. The connector of claim 16, wherein the second crimping portion has the U-shaped base and the pair of linear side portions each extending from a side of the U-shaped base.

18. The connector of claim 14, wherein the pressing portion has a flat surface adapted to engage a front end surface of the terminal position assurance, the terminal position assurance pushing the conductive terminal forward.

19. The connector of claim 14, wherein a rear end surface of the U-shaped base is a flat surface, the pressing portion is connected to the rear end surface of the U-shaped base and bent outwardly by approximately 90° with respect to the U-shaped base.

20. The connector of claim 19, wherein the pressing portion is also disposed on the linear side portions of the second crimping portion.

* * * * *